US005699886A

United States Patent [19]

Latshaw

[11] Patent Number: 5,699,886

[45] Date of Patent: Dec. 23, 1997

[54] LUGGAGE HAVING SUPPLEMENTARY TOW HANDLE FOR WHEELED LUGGAGE AND METHOD OF TOWING COMBINATION OF SAME

[75] Inventor: Ricky J. Latshaw, Republic, Mo.

[73] Assignee: Purdy Neat Things Co., Inc., Republic, Mo.

[21] Appl. No.: 558,968

[22] Filed: Nov. 13, 1995

[51] Int. Cl.[6] ..... A45C 13/26

[52] U.S. Cl. ..... 190/108; 190/115

[58] Field of Search ..... 190/18 A, 108, 190/115, 116

[56] References Cited

U.S. PATENT DOCUMENTS

| | | | |
|---|---|---|---|
| 2,707,035 | 4/1955 | Lashley | 190/108 X |
| 3,958,731 | 5/1976 | Riedle . | |
| 4,094,391 | 6/1978 | Ratchford . | |
| 4,420,068 | 12/1983 | Gerch . | |
| 4,436,189 | 3/1984 | Baum | 190/108 |
| 4,538,709 | 9/1985 | Williams et al. . | |
| 4,618,035 | 10/1986 | Mao . | |
| 4,759,431 | 7/1988 | King et al. | 190/18 A |
| 5,031,766 | 7/1991 | Cohen . | |
| 5,099,968 | 3/1992 | Kikuchi | 190/108 |
| 5,353,900 | 10/1994 | Stilley . | |
| 5,375,685 | 12/1994 | Plath . | |
| 5,501,308 | 3/1996 | King | 190/18 A X |
| 5,547,053 | 8/1996 | Liang | 190/18 A X |
| 5,560,458 | 10/1996 | Franklin et al. | 190/108 X |

*Primary Examiner*—Allan W. Shoap
*Assistant Examiner*—Christopher J. McDonald
*Attorney, Agent, or Firm*—Allen, Dyer, Doppelt, Milbrath & Gilchrist, P.A.

[57] ABSTRACT

A luggage system of the present invention is provided for transporting an additional piece of luggage having a supplementary tow handle when positioned on a piece of wheeled luggage. The luggage system preferably includes a first piece of wheeled luggage including a body, wheels connected to lower end portions of the body, and a wheeled luggage tow handle connected to the body for towing the wheeled luggage. A second piece of luggage detachably mounts to the wheeled luggage tow handle of the first piece of luggage and is positioned to overlie upper portions of the body of the first piece of wheeled luggage. The second piece of luggage preferably includes a body, a handle retainer connected to the body for retaining the wheeled luggage tow handle, and a supplementary towing handle connected to the body for towing the combination of the first and second pieces of luggage. A method for towing a combination of a piece of luggage and a piece of wheeled luggage by a user is also provided. The method preferably includes retaining at least portions of a handle of a first piece of wheeled luggage with a handle retainer connected to a second piece of luggage and towing a combination of the first and second piece of luggage by a hand of a user only by a supplementary tow handle connected to the second piece of luggage.

31 Claims, 4 Drawing Sheets

LUGGAGE HAVING SUPPLEMENTARY TOW HANDLE FOR WHEELED LUGGAGE AND METHOD OF TOWING COMBINATION OF SAME

FIELD OF THE INVENTION

This invention relates to luggage and more particularly to a wheeled luggage system for more conveniently carrying personal and business items during travel.

BACKGROUND OF THE INVENTION

Extensive travel often requires a traveller to handle their own luggage in walking through airports, hotels, or other various assembling and marshalling areas. The luggage is usually heavy when fully loaded and, therefore, a traveller often uses a dolly truck, bell-hop, or sky-cap to transport the luggage through these assembling and marshalling areas and to their destinations. These methods of transporting the luggage, however, are sometimes impractical, difficult, expensive, or burdensome to the traveller.

To solve this luggage transporting problem, wheels and retractable handles have been added to luggage to enable the traveller to easily transport the luggage through airports, hotels, and the like. Some examples of early types of wheeled luggage may be seen in U.S. Pat. No. 2,925,283 by Stilger titled "Luggage On Wheels"; U.S. Pat. No. Re. 28,757 by Cassimally titled "Trolley Case"; and U.S. Pat. No. Re. 29,036 by Hager titled "Luggage Transport Structure." Some of the recent popularity of wheeled luggage may have developed from the increased popularity of airline travel.

In addition to a piece of wheeled luggage, a traveller, however, often has multiple pieces of luggage for towing through airports. These additional pieces, for example, may include a garment bag for suits or dresses, a briefcase, a portable computer, an additional suitcase, or other luggage which does not require checking, loading, and transporting the luggage by the airline itself. Also, the traveller often is faced with the decision of packing more belongings, i.e., clothing, files, etc., than they can physically carry versus making sure they have all the belongings that may be needed due to inclement weather, business situations, or the like arising during travel. Further, the traveller often experiences problems with transporting the additional luggage through various marshalling areas and the like.

Although travellers conventionally mount an additional piece of luggage to a piece of wheeled luggage to thereby use the wheeled luggage as a dolly or hand truck, these prior methods of mounting additional luggage have been to a forward portion of the luggage such as mounting the main body handle of the additional piece of luggage to a hook such as seen in U.S. Pat. No. 5,295,565 by Latshaw, inventor of the present invention, titled "Wheeled Luggage" and U.S. Pat. No. 4,094,391 by Ratchford titled "Suitcase With Wheels And Transporting Hook." Also, an additional piece of luggage may be positioned to abut against the extended handle of the wheeled luggage for a stacking type of arrangement. These conventional methods of mounting of additional luggage, however, have problems because the additional luggage has a tendency to slide off of the mounting system, for example, due to awkward balancing of the luggage during towing, the additional luggage having little or no means for securing to the wheeled luggage, and the uncertainty of the traveller in selecting an appropriate mounting location for towing the combination of luggage pieces.

OBJECTS AND SUMMARY OF THE INVENTION

It is an object of the present invention to provide a luggage system and a method of towing luggage so that an additional piece of luggage may readily mount to a piece of wheeled luggage for towing the combination of pieces of luggage such as during travel in and around marshalling areas.

It is also an object of the present invention to provide a luggage system and a method of towing that readily allows an additional piece of luggage to be mounted to, carried by, and securely towed in combination with a piece of wheeled luggage.

It is also an object of the present invention to provide a piece of luggage having a supplementary handle and handle pocket for retaining and towing a tow handle of a piece of wheeled luggage.

It is also an object of the present invention to provide a supplementary tow handle for a piece of luggage to allow the additional piece of luggage to readily mount to a piece of wheeled luggage for towing a combination of the luggage having the supplementary tow handle and the wheeled luggage.

A luggage system of the present invention is provided for transporting an additional piece of luggage having a supplementary tow handle when positioned on a piece of wheeled luggage. By providing a supplementary tow handle on a piece of additional luggage, preferably in addition to the main handle of the additional piece of luggage, a traveller or user of the system can readily mount the luggage to the tow handle of the wheeled luggage so that the combination of the additional piece of luggage and the wheeled luggage can be readily towed in a secure manner. The luggage system, luggage, and method of towing according to the present invention advantageously provides a simple and yet secure manner for mounting and towing additional luggage to conventional wheeled luggage. Because a supplemental tow handle according to the present invention can be provided on numerous types of additional pieces of luggage, e.g., garment bags, suitcases, duffle bags, etc., a user can select or purchase the types of bags most preferred for the user's travel needs and yet have a system for readily mounting and towing the selected luggage with wheeled luggage.

More particularly, the luggage system of the present invention preferably includes a first piece of wheeled luggage including a body, wheels connected to lower end portions of the body, and a wheeled luggage tow handle connected to the body for towing the wheeled luggage. A second piece of luggage detachably mounts to the wheeled luggage tow handle of the first piece of luggage and preferably is positioned to overlie upper portions of the body of the first piece of wheeled luggage. The second piece of luggage preferably includes a body, a handle retainer connected to the body for retaining at least portions of the wheeled luggage tow handle, and a supplementary towing handle connected to the body for towing the combination of the first and second pieces of luggage.

A piece of luggage according to the present invention preferably includes a body, a handle retainer connected to the body for retaining at least portions of a tow handle of a piece of wheeled luggage, and a supplementary towing handle connected to the body for towing the combination of the luggage and a piece of wheeled luggage.

A method for towing a combination of a piece of luggage and a piece of wheeled luggage by a user is also provided by the present invention. The method preferably includes retaining at least portions of a handle of a first piece of wheeled luggage with a handle retainer connected to a second piece of luggage and towing a combination of the first and second piece of luggage by a hand of a user only by a supplementary tow handle connected to the second piece of luggage.

BRIEF DESCRIPTION OF THE DRAWINGS

Some of the features and advantages of the present invention having been stated, others will become apparent as the description proceeds when taken in conjunction with the accompanying drawings, in which.

DETAILED DESCRIPTION

The present invention now will be described more fully hereinafter with reference to the accompanying drawings in which preferred embodiments of the invention are shown. This invention may, however, be embodied in many different forms and should not be construed as limited to the illustrated embodiments set forth herein; rather these embodiments are provided so that this disclosure will be thorough and complete and will fully convey the scope of the invention to those skilled in the art. Like numbers refer to like elements throughout.

Figure 1:
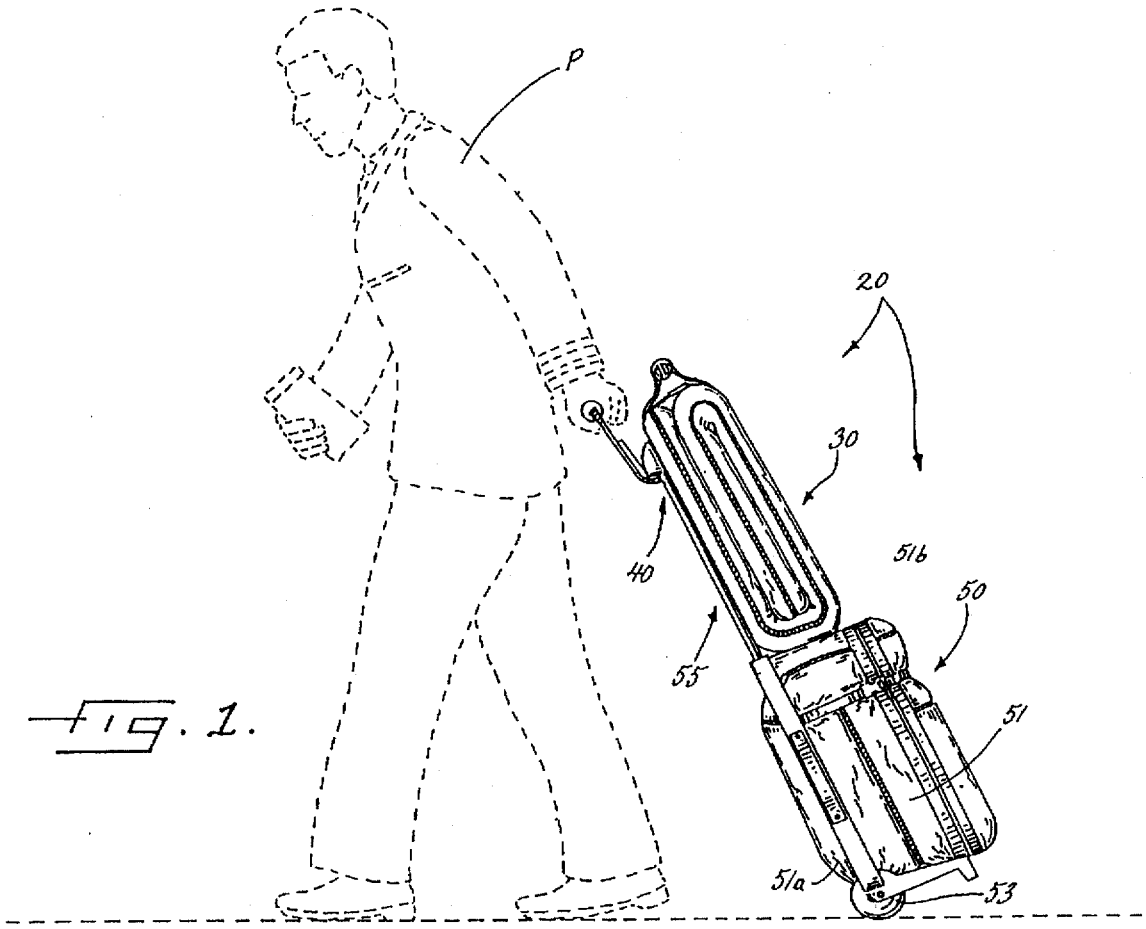
FIG. 1 illustrates an environmental view of a luggage system according to a first embodiment of the present invention being towed by an airplane pilot shown in phantom lines.
Figure 2:
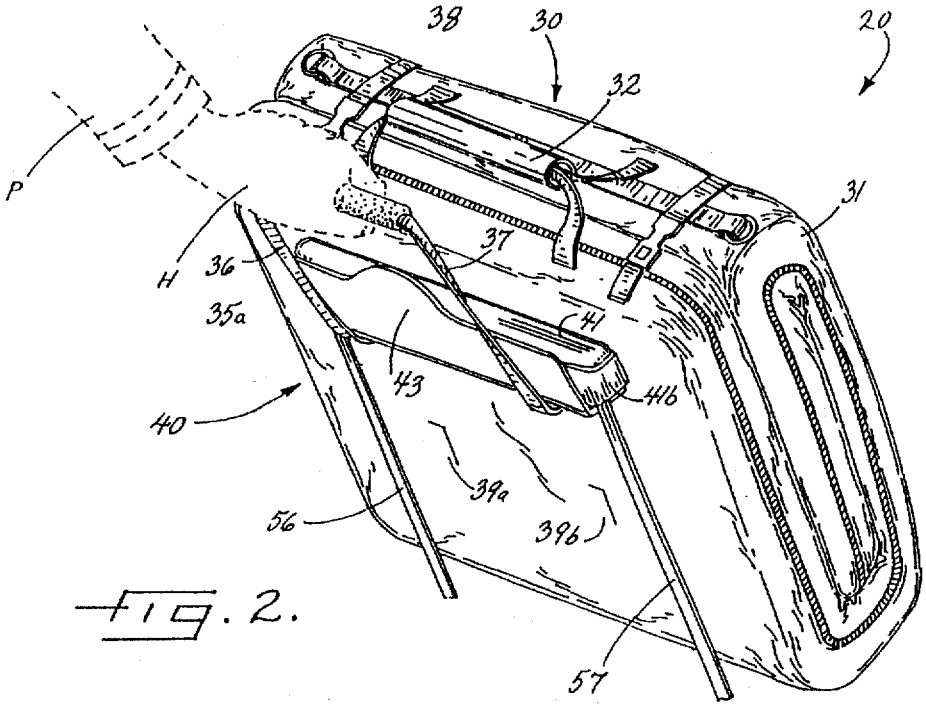
FIG. 2 illustrates an environmental view of a luggage system according to a first embodiment of the present invention being towed only with a supplementary tow handle by a hand of user, such as an airline traveller, shown in phantom lines.
Figure 3:
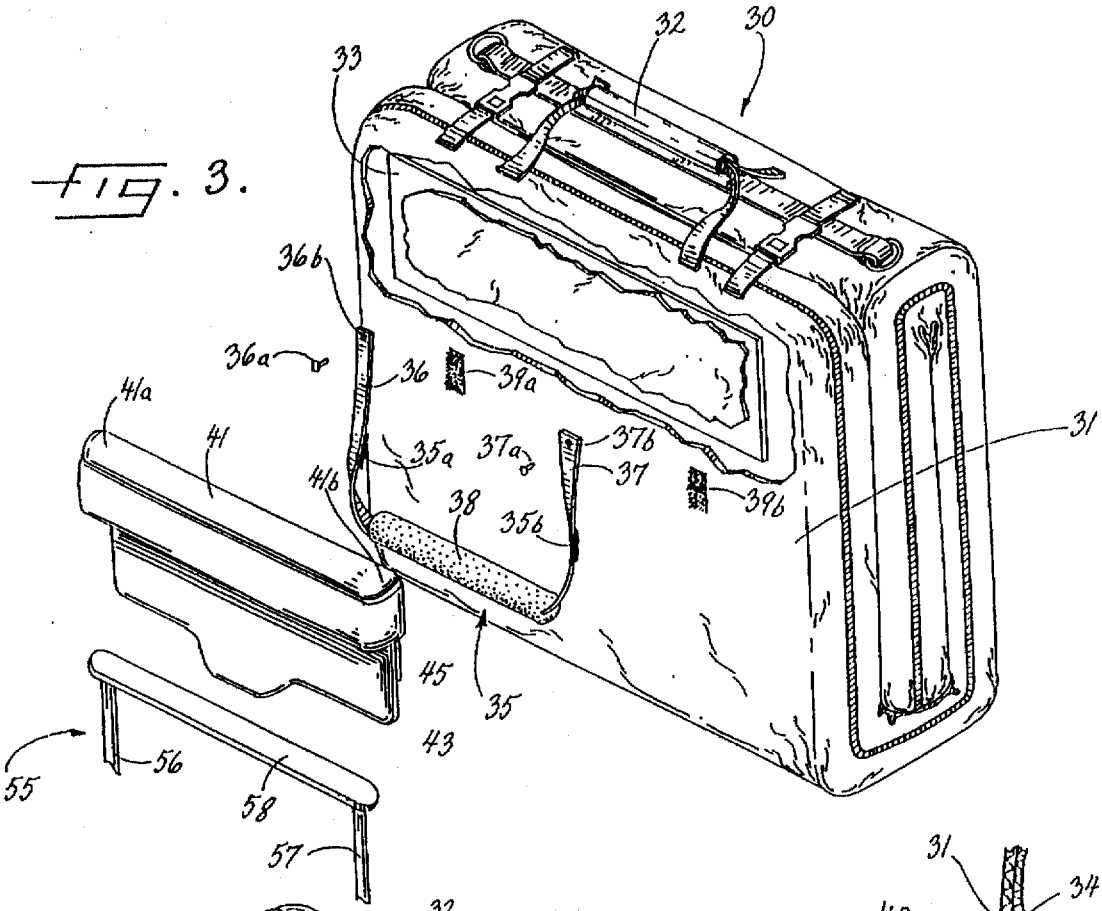
FIG. 3 illustrates a fragmentary exploded view of a luggage system according to a first embodiment of the present invention.

FIGS. 1–3 illustrate a luggage system 20 for transporting an additional piece of luggage 30 when positioned on a piece of wheeled luggage 50 according to a first embodiment of the present invention. As best illustrated in FIGS. 1–3 and 5, the luggage system 20 preferably includes a first piece of wheeled luggage 50 including a body 51, at least one wheel, and preferably a pair of wheels 52 (not shown), 53, connected to lower end portions 51*a* of the body 51, and a wheeled luggage tow handle 55 connected to the body 51 for towing the wheeled luggage 50. Wheeled luggage is known and understood by those skilled in the art, and it will be understood by those skilled in the art that the present invention is applicable to various types of wheeled luggage. An example of such a wheeled luggage is illustrated in U.S. Pat. No. 5,295,565 by Latshaw, inventor of the present invention, titled "Wheeled Luggage," which is hereby incorporated herein in its entirety by reference. The wheeled luggage tow handle 55 preferably has a pair of elongate retractable members 56, 57 extending upwardly from the body 51 of the wheeled luggage 50 and a handle grip member 58 connected to and extending transversely between the pair of elongate retractable members 56, 57.

Figure 4:
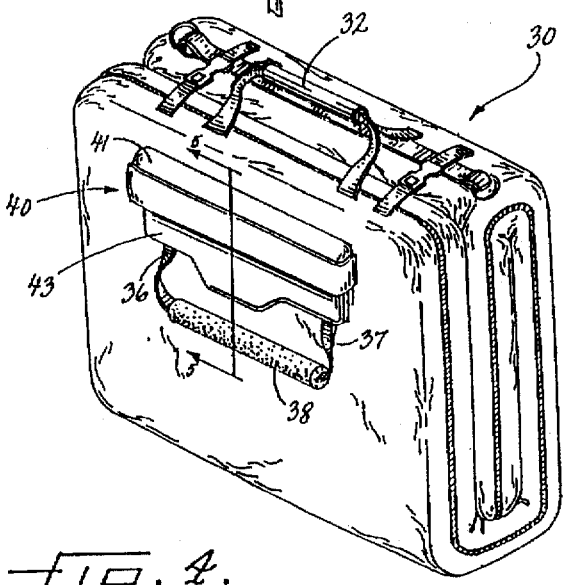
FIG. 4 illustrates a piece of luggage in the form of a garment bag having a supplementary tow handle according to a first embodiment of the present invention.
Figure 5:
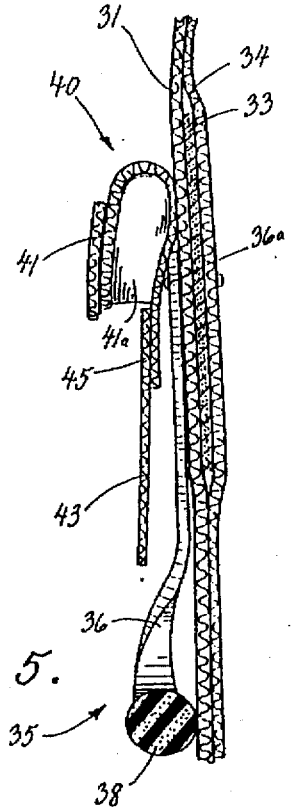
FIG. 5 illustrates a sectional view taken along line 5—5 of FIG. 4 of a piece of luggage having a supplementary tow handle according to a first embodiment of the present invention.

As best shown in FIGS. 3–5, the luggage system 20 also includes a second piece of luggage 30, illustrated in the form of a garment bag, detachably mounted to the wheeled luggage tow handle 55 of the first piece of wheeled luggage 50 and positioned to overlie upper portions of the body 51 of the first piece of luggage 50. The second piece of luggage preferably includes a body 31, means 40 connected to the body for retaining the wheeled luggage tow handle 55, and supplementary towing means 35 connected to the body for towing the combination of the first 50 and second 30 pieces of luggage. The supplementary towing means preferably is a supplementary tow handle 35 connected to the body 31 of the second piece of luggage 30, e.g., a garment bag, a briefcase, a portable computer case, a duffle bag, suitcase, or other luggage as understood by those skilled in the art. The supplementary tow handle 35 preferably is also positioned closely adjacent the retaining means 40 so that the supplementary tow handle 35 is operatively engaged by a hand H of a user, such as a pilot P or other traveller, between the pair of elongate members 56, 57 and, as best illustrated in FIG. 1, so that the supplementary tow handle 35 is the only handle engaged by a hand H of a user for towing the combination of the first and second pieces of luggage 30, 50.

The supplementary tow handle preferably has a pair of elongate and spaced-apart straps 36, 37 having distal end portions thereof connected to the body 31 and a supplementary grip member 38 connected to and extending between proximal end portions of the pair of straps 36, 37. Medial portions of the pair of straps 36, 37 are detachably connected to the body 31 preferably by a pair of mating VELCRO-type fasteners 35*a*, 35*b*, 39*a*, 39*b* so that medial portions of the pair of straps 36, 37 and the supplementary grip member 38 operatively extend outwardly and upwardly from the body 31 during towing and nonoperatively extend outwardly and downwardly to overlie portions of the body 31.

The second piece of luggage further includes a backing member 33, as best shown in FIGS. 3 and 5, connected to at least the body 31 and the supplementary handle 35 of the second piece of luggage 30, e.g., preferably by fasteners 36*a*, 37*a* through openings in distal end portions 36*b*, 37*b* of the straps 36, 37. The backing member 33 preferably is formed of a relatively stiff material, such as pressed paperboard, and has a transverse extent across the body 31 of the second piece of luggage 30 greater than the transverse extent between the pair of elongate and spaced-apart members 56, 57 of the wheeled luggage towing handle 55 for providing operative support for the supplementary tow handle 35 during towing. The backing member 33, for example, preferably extends about 1–2 inches beyond each of the side peripheries of the wheeled luggage tow handle 55. This reduces distortion in the outer surface of the second piece of luggage 30 and provides structure support and strength from the force of the tow handle 35 being pulled by the user.

Figure 9:
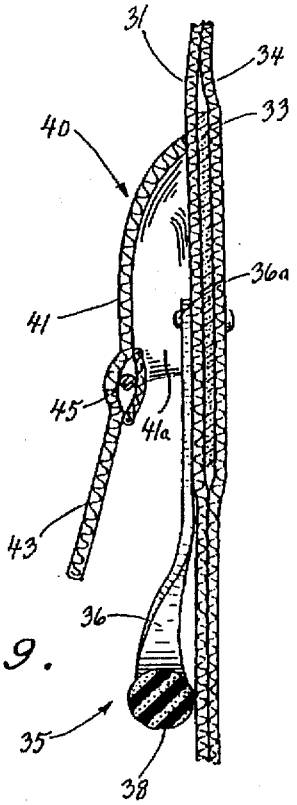
FIG. 9 illustrates a sectional view taken along line 8—8 of FIG. 8 of a piece of luggage having a supplementary tow handle according to a second embodiment of the present invention.

As best shown in FIGS. 2–3, the retaining means 40 of the second piece of luggage 30 of the luggage system 20 according to a first embodiment of the present invention preferably includes a handle pocket 41 positioned to overlie portions of the supplementary tow handle 35 and positioned to retain the handle grip member 58 of the wheeled luggage tow handle 55 in the handle pocket 41. The handle pocket 41 preferably has a pair of side panel members 41*a*, 41*b* which assist in defining the pocket 41, The retaining means 40 preferably further includes a flexible fabric member 43, preferably formed of leather, vinyl, or other flexible fabric commonly used for luggage, connected to and extending downwardly from the body 31, and positioned to overlie at least distal end portions of the pair of elongate straps 36, 37 of the supplementary tow handle 35 (see FIG. 5) so that during operative engagement of the supplementary tow handle 35 by a hand H of a user the elongate straps 36, 37 operatively contact the flexible fabric member 43 and detachably secure the handle grip member 58 of the wheeled luggage tow handle 55 within the handle pocket 41 for securely towing of the combination of the first and second pieces 30, 50 of luggage. The closure formed by the flexible fabric member 43 extending upwardly due to the force of the straps 36, 37 of the handle 35 being operatively towed by the user forms a lower end of the pocket 41 and provides additional means for Securing or enclosing the grip member 58 of the handle within the pocket 41. The retaining means 40 also preferably includes a reinforcing member 45 connected to and extending transversely across at least portions of the flexible fabric member 43 for reinforcing and strengthening the flexed or bent portions of the flexible fabric member 43 when the handle grip member 58 is operatively positioned in the handle pocket 41 during towing. The reinforcing member 45 preferably is thickened fabric having reinforced stitching therein as illustrated (see FIG. 5), but as understood by those skilled in the art the reinforcing member 43 may be other structures such as a wire member positioned in a sleeve as illustrated in FIG. 9.

Figure 6:
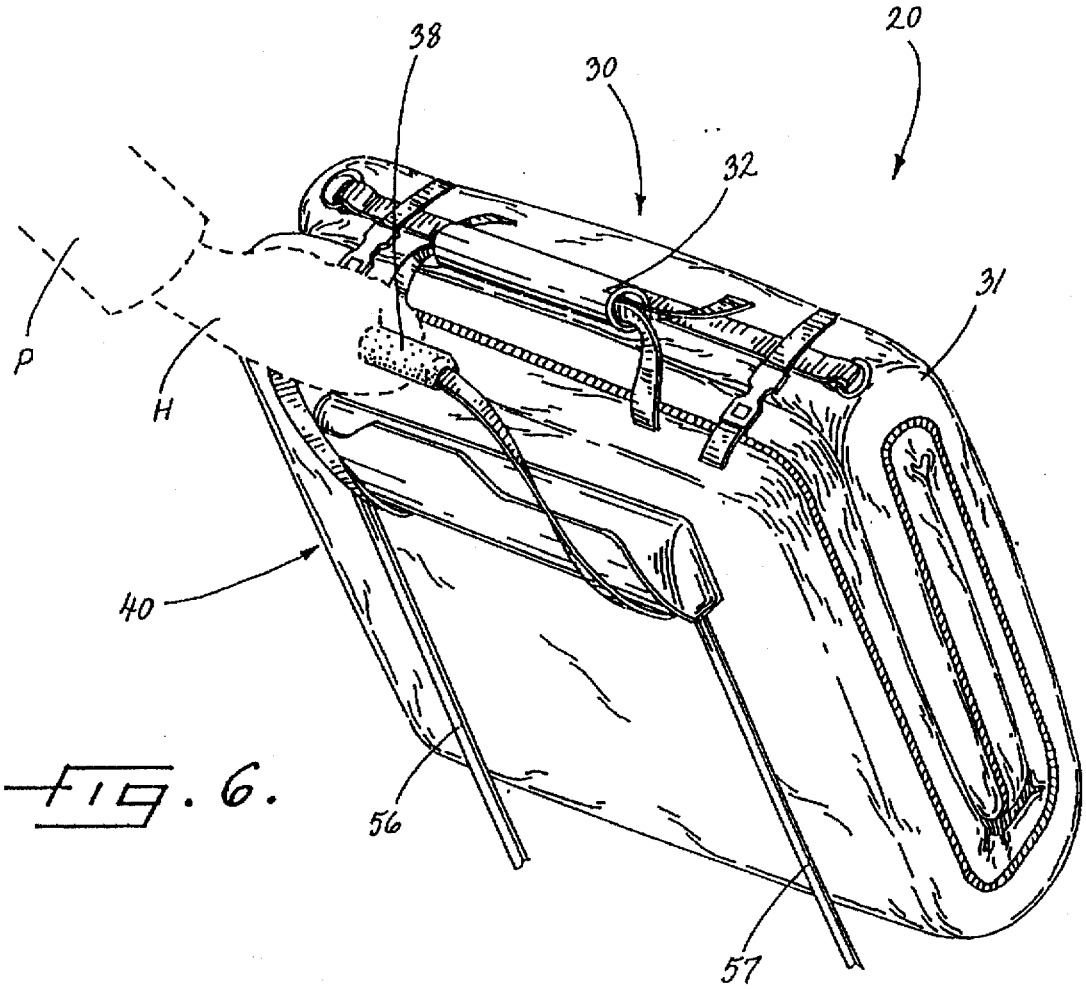
FIG. 6 illustrates an environmental view of a luggage system according to a second embodiment of the present invention being towed only with a supplementary tow handle by a hand of user, such as an airline traveller, shown in phantom lines.
Figure 7:
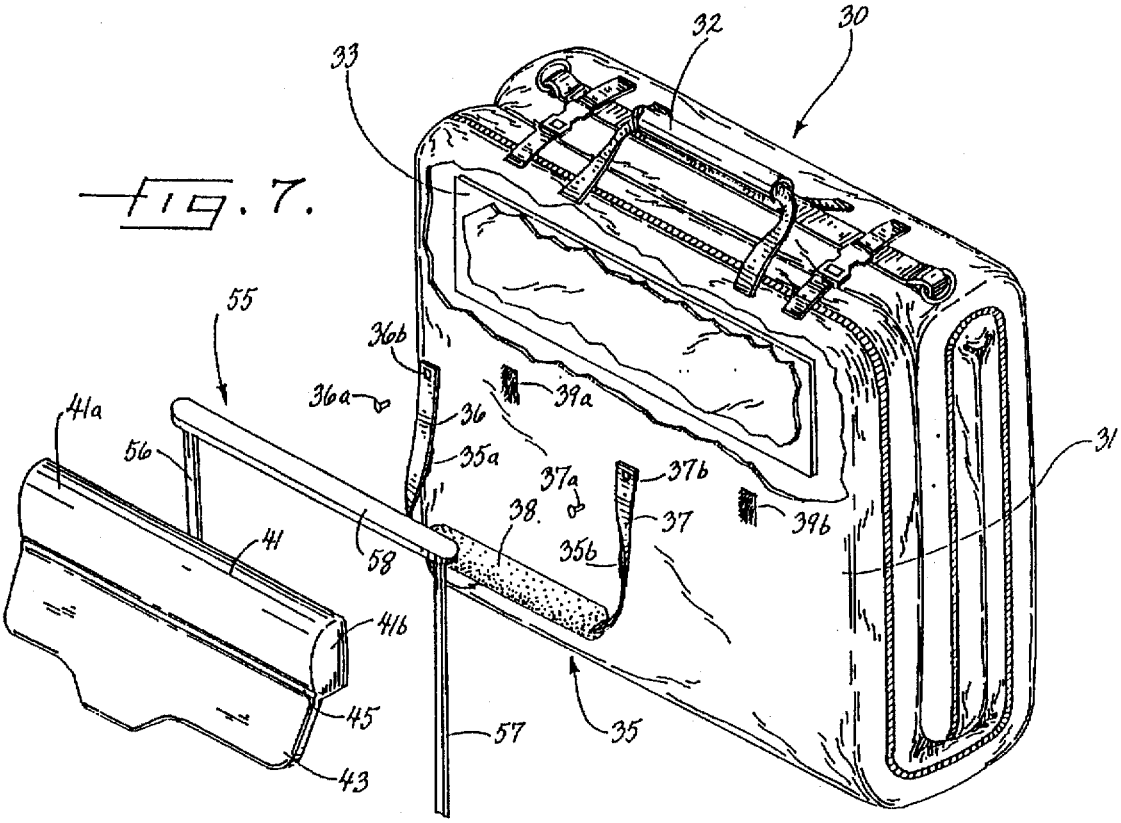
FIG. 7 illustrates a fragmentary exploded view of a luggage system according to a second embodiment of the present invention.
Figure 8:
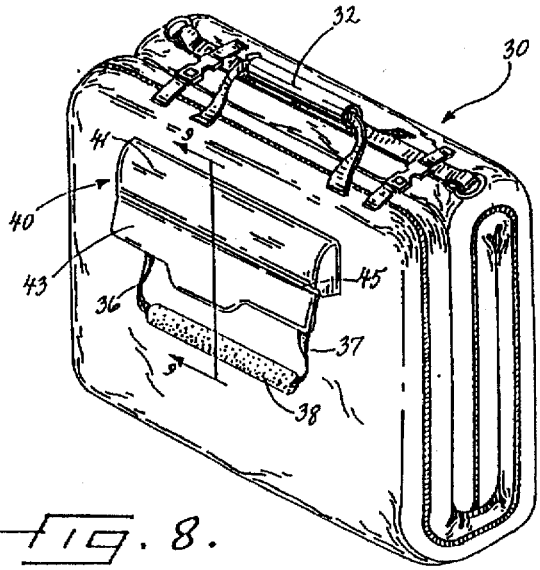
FIG. 8 illustrates a piece of luggage in the form of a garment bag having a supplementary tow handle according to a second embodiment of the present invention.

As best shown in FIGS. 6–7, like elements having a prime (') notation, the retaining means 40 of the second piece of luggage 30' of a luggage system 20' according to a second embodiment of the present invention preferably includes a handle pocket 47 positioned to overlie portions of the supplementary tow handle 35' and positioned to retain the handle grip member 58' of the wheeled luggage tow handle 55' in the handle pocket 47. The handle pocket 47 preferably has a pair of side panel members 47*a*, 47*b* which assist in defining the pocket 47. In this second embodiment, the pocket 47 preferably extends downwardly toward lower end portions of the luggage 30' to such a distance so that ready displacement of the handle grip member 58' from the pocket 47 does not occur. Likewise, the connection of the end portions of the pair of straps 36', 37' are preferably positioned at medial or lower end portions within the downwardly extending pocket 47 to prevent ready displacement of the handle grip member 58' from the pocket 47.

The retaining means 40 preferably further includes a flexible fabric member 48 connected to and extending downwardly from the body 31' so that a portion of the outer surface of the body 31' and inner surfaces of the flexible fabric member 48 define inner walls of the pocket 47. The distal end portions of the pair of elongate straps 36', 37' of the supplementary tow handle 35' are connected to the body 31' and are positioned within the handle pocket 47 so that during operative engagement of the supplementary tow handle 35' by a hand H of a user the elongate straps 36', 37' operatively contact the pocket 47 and detachably secure the handle grip member 58' of the wheeled luggage tow handle 55' within the handle pocket 47 for securely towing of the combination of the first and second pieces 30', 50' of luggage.

As illustrated in FIGS. 1–9, the present invention also provides a method for towing a combination of a piece of luggage 30 and a piece of wheeled luggage 50 by a user. The method preferably includes retaining at least portions of a tow handle 55 of a first piece of wheeled luggage 50 with a handle retainer 40 connected to a second piece of luggage 30, engaging a supplementary tow handle 35 connected to the second piece of luggage 30 by a hand H of a user, and towing a combination of the first and second pieces 30, 50 of luggage by the supplementary tow handle 35 connected to the second piece of luggage 30. The wheeled luggage handle 55 preferably includes a pair of elongate and spaced-apart members 56, 57 so that the method further includes operatively positioning the supplementary tow handle 35 between a pair of elongate and spaced-apart members 56, 57 of the wheeled luggage handle 55.

The handle retainer 40 preferably includes a handle pocket 41 connected to the second piece of luggage 30 and a flexible fabric member 43 connected to the second piece of luggage 30 and positioned closely adjacent the handle pocket 41 so that the retaining step described above includes positioning at least portions, e.g., the handle grip member 58, of the wheeled luggage handle 55 within the handle pocket 41 of the handle retainer 40 and operatively positioning the supplementary tow handle 35 between the pair of elongate members 56, 57 of the wheeled luggage handle 55 so that the flexible fabric member 43 of the handle retainer 40 operatively contacts the handle pocket 41 for detachable securing at least portions of the wheeled luggage handle 55 therein.

A method for towing a combination of a piece of luggage 30 and a piece of wheeled luggage 50 by a user is also provided which includes retaining at least portions of a handle 55 of a first piece of wheeled luggage 50 with a handle retainer 40 connected to a second piece of luggage 30 and towing a combination of the first and second pieces 30, 50 of luggage by a hand H of a user only by a supplementary tow handle 35 connected to the second piece of luggage 30.

A luggage system 20 according to the present invention provides a means for transporting an additional piece of luggage 30 having a supplementary tow handle 35 when positioned on a piece of wheeled luggage 50. By providing a supplementary tow handle 35 on a piece of additional luggage 30, preferably in addition to the main handle 32 of the additional piece of luggage 30, a traveller or user of the system 20 can readily mount the luggage 30 to the tow handle 35 of the wheeled luggage 50 so that the combination of the additional piece of luggage 30 and the wheeled luggage 50 can be readily towed in a secure manner. The luggage system 20, luggage 30, and method of towing according to the present invention, and as described above herein, advantageously provides a simple and yet secure manner for mounting and towing additional luggage 30 to conventional wheeled luggage 50. Because a supplemental tow handle 35 according to the present invention can be provided on numerous types of additional pieces of luggage, e.g., garment bags, suitcases, duffle bags, etc., a user can select or purchase the types of bags most preferred for the user's travel needs and yet have a system 20 which provides a ready and secure mount to wheeled luggage.

In the drawings and specification, there have been disclosed typical preferred embodiments of the invention, and, although specific terms have been employed, they have been used in a descriptive sense only and not for purposes of limitations. The invention has been described in considerable detail with specific reference to various illustrated embodiments. It will be apparent, however, that various modifications and changes can be made within the spirit and scope of the invention as described in the foregoing specification and defined in the appended claims.

That which is claimed:

1. A luggage system for transporting an additional piece of luggage when positioned on a piece of wheeled luggage, the luggage system comprising:

a first piece of wheeled luggage including a body, at least one wheel connected to lower end portions of said body, and a wheeled luggage tow handle connected to said body for towing said wheeled luggage; and a second piece of luggage detachably mounted to said wheeled luggage tow handle of said first piece of wheeled luggage and positioned to overlie upper portions of said body of said first piece of luggage, said second piece of luggage including a body, means connected to said body for retaining at least portions of said wheeled luggage tow handle, and supplementary towing means connected to said body for towing the combination of said first and second pieces of luggage.

2. A luggage system as defined in claim 1, wherein said wheeled luggage tow handle comprises a pair of elongate retractable members extending upwardly from said body of said wheeled luggage and a handle grip member connected to and extending transversely between said pair of elongate retractable members, and wherein said supplementary towing means comprises a supplementary tow handle connected to said body and positioned closely adjacent said retaining means so that said supplementary tow handle is operatively engaged by a hand of a user between said pair of elongate members and so that said supplementary tow handle is the only handle engaged by a hand of a user for towing the combination of said first and second pieces of luggage.

3. A luggage system as defined in claim 2, wherein said retaining means of said second piece of luggage includes a handle pocket positioned to overlie portions of said supplementary handle and positioned to retain said handle grip member of said wheeled luggage tow handle in said handle pocket.

4. A luggage system as defined in claim 2, wherein said second piece of luggage further includes a backing member connected to at least said body and said supplementary handle of said second piece of luggage, said backing member having a transverse extent across said body greater than the transverse extent between said pair of elongate members of said wheeled luggage towing handle for providing operative support for said supplementary tow handle during towing.

5. A luggage system as defined in claim 3, wherein said supplementary tow handle includes a pair of elongate and spaced-apart straps having distal end portions thereof connected to said body and a supplementary grip member connected to and extending between proximal end portions of said pair of straps, medial portions of said pair of straps being detachably connected to said body so that medial portions of said pair of straps and said supplementary grip member operatively extend outwardly and upwardly from said body during towing and nonoperatively extend outwardly and downwardly to overlie portions of said body.

6. A luggage system as defined in claim 5, wherein said retaining means further includes a flexible fabric member connected to and extending downwardly from said body so that a portion of the outer surface of said body and inner surfaces of said flexible fabric member defines inner walls of said pocket, and wherein the distal end portions of said pair of elongate straps of said supplementary tow handle are connected to said body and are positioned within said handle pocket so that during operative engagement of said supplementary tow handle by a hand of a user said elongate straps operatively contact said pocket and detachably secure said handle grip member of said wheeled luggage tow handle within said handle pocket for securely towing of the combination of said first and second pieces of luggage.

7. A luggage system as defined in claim 5, wherein said retaining means further includes a flexible fabric member connected to and extending downwardly from said body, and positioned to overlie at least distal end portions of said pair of elongate straps of said supplementary tow handle so that during operative engagement of said supplementary tow handle by a hand of a user said elongate straps operatively contact said flexible fabric member and detachably secure said handle grip member of said wheeled luggage tow handle within said handle pocket for securely towing of the combination of said first and second pieces of luggage.

8. A luggage system as defined in claim 3, wherein said retaining means further includes a reinforcing member connected to and extending transversely across at least portions of said flexible fabric member for reinforcing said flexible fabric member when said handle grip member is operatively positioned in said handle pocket during towing.

9. A luggage system for transporting an additional piece of luggage when positioned on a piece of wheeled luggage, the luggage system comprising;

a first piece of wheeled luggage including a body, at least one wheel connected to lower end portions of said body, and a wheeled luggage tow handle connected to said body of said first piece of wheeled luggage for towing said first piece of wheeled luggage; and a second piece of luggage detachably mounted to said wheeled luggage tow handle of said first piece of wheeled luggage and positioned to overlie upper portions of said body of said first piece of wheeled luggage, said second piece of luggage including a body, a handle retainer connected to said body for retaining at least portions of said wheeled luggage tow handle, and a supplementary towing handle connected to said body of said second piece of luggage for towing the combination of said first and second pieces of luggage.

10. A luggage system as defined in claim 9, wherein said wheeled luggage tow handle comprises a pair of elongate retractable members extending upwardly from said body of said wheeled luggage and a handle grip member connected to and extending transversely between said pair of elongate retractable members, and wherein said supplementary tow handle is positioned closely adjacent said handle retainer so that said supplementary tow handle is operatively engaged by a hand of a user between said pair of elongate members and so that said supplementary tow handle is the only handle engaged by a hand of a user for towing the combination of said first and second pieces of luggage.

11. A luggage system as defined in claim 10, wherein said handle retainer of said second piece of luggage includes a handle pocket positioned to overlie portions of said supplementary handle and positioned to retain said handle grip member of said wheeled luggage tow handle in said handle pocket.

12. A luggage system as defined in claim 11, wherein said second piece of luggage further includes a backing member connected to at least said body and said supplementary handle of said second piece of luggage, said backing member having a transverse extent across said body greater than the transverse extent between said pair of elongate members of said wheeled luggage towing handle for providing operative support for said supplementary tow handle during towing.

13. A luggage system as defined in claim 12, wherein said supplementary tow handle includes a pair of elongate and spaced-apart straps having distal end portions thereof connected to said body and a supplementary grip member connected to and extending between proximal end portions of said pair of straps, medial portions of said pair of straps being detachably connected to said body so that medial portions of said pair of straps and said supplementary grip member operatively extend outwardly and upwardly from said body during towing and nonoperatively extend outwardly and downwardly to overlie portions of said body.

14. A luggage system as defined in claim 13, wherein said handle retainer further includes a flexible fabric member connected to and extending downwardly from said body so that a portion of the outer surface of said body and inner surfaces of said flexible fabric member defines inner walls of said handle pocket, and wherein at least distal end portions of said pair of elongate straps of said supplementary tow handle are connected to said body and are positioned within said handle pocket so that during operative engagement of said supplementary tow handle by a hand of a user said elongate straps operatively contact said handle pocket and detachably secure said handle grip member of said wheeled luggage tow handle within said handle pocket for securely towing of the combination of said first and second pieces of luggage.

15. A luggage system as defined in claim 13, wherein said handle retainer further includes a flexible fabric member connected to and extending downwardly from said body, and positioned to overlie at least distal end portions of said pair of elongate straps of said supplementary tow handle so that during operative engagement of said supplementary tow handle by a hand of a user said elongate straps operatively contact said flexible fabric member and detachably secure said handle grip member of said wheeled luggage tow handle within said handle pocket for securely towing of the combination of said first and second pieces of luggage.

16. A luggage system as defined in claim 15, wherein said handle retainer further includes a reinforcing member connected to and extending transversely across said flexible fabric member for reinforcing said flexible fabric member when said handle grip member is operatively positioned in said handle pocket during towing.

17. A piece of luggage comprising;

a body;

a handle retainer connected to said body of the piece of luggage for retaining at least portions of a tow handle of an additional piece of wheeled luggage when the piece of luggage overlies upper portions of an additional piece of wheeled luggage; and a supplementary handle having means connected to said body for towing the combination of the piece of luggage and an additional piece of wheeled luggage.

18. A piece of luggage as defined in claim 17, wherein said supplementary handle towing means comprises a supplemental tow handle positioned closely adjacent said handle retainer so that said supplementary tow handle is operatively engaged by a hand of a user and is the only handle engaged by a hand of a user for towing a combination of the luggage and a piece of wheeled luggage.

19. A piece of luggage as defined in claim 18, wherein said handle retainer includes a handle pocket positioned to overlie portions of said supplementary handle and positioned to receive portions of a tow handle of a piece of wheeled luggage therein.

20. A piece of luggage as defined in claim 19, wherein said second piece of luggage further includes a backing member connected to at least said body and said supplementary handle of said second piece of luggage for providing operative support for said supplementary tow handle during towing.

21. A piece of luggage system as defined in claim 20, wherein said supplementary tow handle includes a pair of elongate and spaced-apart straps having distal end portions thereof connected to said body and a supplementary grip member connected to and extending between proximal end portions of said pair of straps, medial portions of said pair of straps being detachably connected to said body so that medial portions of said pair of straps and said supplementary grip member operatively extend outwardly and upwardly from said body during towing and nonoperatively extend outwardly and downwardly to overlie said body.

22. A piece of luggage as defined in claim 21, wherein said handle retainer further includes a flexible fabric member connected to and extending downwardly from said body so that a portion of the outer surface of said body and inner surfaces of said flexible fabric member define inner walls of said handle pocket, and wherein the distal end portions of said pair of elongate straps of said supplementary tow handle are connected to said body and are positioned within said handle pocket so that during operative engagement of said supplementary tow handle by a hand of a user said elongate straps operatively contact said handle pocket and detachably secure to a tow handle of a piece of wheeled luggage positioned within said handle pocket for securely towing of a combination of the luggage and a piece of wheeled luggage.

23. A luggage system as defined in claim 21, wherein said handle retainer further includes a flexible fabric member connected to and extending downwardly from said body, and positioned to overlie at least distal end portions of said pair of elongate straps of said supplementary tow handle so that during operative engagement of said supplementary tow handle by a hand of a user said elongate straps operatively contact said flexible fabric member and detachably secure at least portions of a handle of a piece of wheeled luggage within said handle pocket for securely towing of a combination of the luggage and a piece of wheeled luggage.

24. A piece of luggage as defined in claim 23, wherein said handle retainer further includes a reinforcing member connected to and extending transversely across at least portions of said flexible fabric member for reinforcing said flexible fabric member when portions of a tow handle of a piece of wheeled luggage is operatively positioned in said handle pocket during towing.

25. A method for towing a combination of a piece of luggage and an additional piece of wheeled luggage by a user, the method comprising:

retaining at least portions of a handle of a first piece of wheeled luggage with a handle retainer connected to a second piece of luggage positioned to overlie upper portions of the first piece of wheeled luggage;

engaging a supplementary tow handle connected to the second piece of luggage by a hand of a user; and towing a combination of the first and second pieces of luggage by the supplementary tow handle connected to the second piece of luggage.

26. A method as defined by claim 25, wherein the wheeled luggage handle includes a pair of elongate and spaced-apart members, and wherein the method further comprises operatively positioning the supplementary tow handle between a pair of elongate members of the wheeled luggage handle.

27. A method as defined by claim 25, wherein the wheeled luggage handle includes a pair of elongate and spaced-apart members, wherein the handle retainer includes a handle pocket connected to the second piece of luggage and a flexible fabric member connected to the second piece of luggage and positioned closely adjacent the handle pocket, and wherein the retaining step comprises positioning at least portions of the wheeled luggage handle within a handle pocket of the handle retainer and operatively positioning the supplementary tow handle between a pair of elongate members of the wheeled luggage handle so that a flexible fabric member of the handle retainer operatively contacts the handle pocket for detachable securing the wheeled luggage handle therein.

28. A method for towing a combination of a piece of luggage and an additional piece of wheeled luggage by a user, the method comprising:

retaining at least portions of a handle of a first piece of wheeled luggage with a handle retainer connected to a second piece of luggage positioned to overlie upper portions of the first piece of wheeled luggage; and towing a combination of the first and second pieces of luggage by a hand of a user only by a supplementary tow handle connected to the second piece of luggage.

29. A luggage system for transporting an additional piece of luggage when positioned on a piece of wheeled luggage, the luggage when positioned on a piece of wheeled luggage, the luggage system comprising;

a first piece of wheeled luggage including a body, at least one wheel connected to lower end portions of said body, and a wheeled luggage tow handle connected to said body for towing said wheeled luggage, said wheeled luggage tow handle including a pair of elongate retractable members extending upwardly from said body of said wheeled luggage and a handle grip member connected to and extending transversely between said pair of elongate retractable members; and a second piece of luggage detachably mounted to said wheeled luggage tow handle of said first piece of wheeled luggage, said second piece of luggage including a body, a handle retainer connected to said body for retaining at least portions of said wheeled luggage tow handle, and a supplementary towing handle connected to said body for towing handle connected to said body for towing the combination of said first and second pieces of luggage, said supplementary tow handle being positioned closely adjacent said handle retainer so that said supplementary tow handle is operatively engaged by a hand of a user between said pair of elongate members and so that said supplementary tow handle is the only handle engaged by a hand of a user for towing the combination of said first and second pieces of luggage.

30. A piece of luggage comprising;

a body;

a handle retainer connected to said body for retaining at least portions of a tow handle of a piece of wheeled luggage, said handle retainer including a handle pocket positioned to receive portions of a tow handle of a piece of wheeled luggage therein; and a supplementary towing handle connected to said body and positioned to underlie portions of said handle pocket for towing the combination of the luggage and a piece of wheeled luggage, said supplementary tow handle being positioned closely adjacent said handle retainer so that said supplementary tow handle is operatively engaged by a hand of a user and is the only handle engaged by a hand of a users for towing a combination of the luggage and a piece of wheeled luggage.

31. A method for towing a combination of a piece of luggage and a piece of wheeled luggage by a user, the method comprising:

retaining at least portions of a handle of a first piece of wheeled luggage with a handle retainer connected to a second piece of luggage, the wheeled luggage handle including a pair of elongate and spaced apart members;

operatively positioning a supplementary tow handle between the pair of elongate members of the wheeled luggage handle;

engaging the supplementary tow handle connected to the second piece of luggage by a hand of a user; and towing a combination of the first and second piece of luggage by the supplementary tow handle connected to the second piece of luggage.

* * * * *